United States Patent [19]

Balyasny et al.

[11] Patent Number: 5,026,301

[45] Date of Patent: Jun. 25, 1991

[54] LEAD TERMINATION

[75] Inventors: Marik Balyasny, Burbank; Raul A. Olivares, Ontario; Arthur C. Sepmeyer, Alhambra, all of Calif.

[73] Assignee: ITT Corporation, New York, N.Y.

[21] Appl. No.: 526,087

[22] Filed: May 21, 1990

[51] Int. Cl.[5] ..... H01R 4/24

[52] U.S. Cl. ..... 439/391; 439/426; 439/825; 439/418; 29/866

[58] Field of Search ..... 439/391, 860, 868, 883, 439/421, 422, 423, 424, 426, 877, 417–419, 825; 29/857, 862, 863, 865, 866

[56] References Cited

U.S. PATENT DOCUMENTS

| | | | |
|---|---|---|---|
| Re. 26,994 | 12/1970 | Fuller et al. | 174/84 |
| 2,291,434 | 10/1940 | Hollopeter et al. | 173/324 |
| 2,783,441 | 2/1957 | Burnosky | 339/96 |
| 2,783,447 | 2/1957 | Watts | 439/423 |
| 2,795,769 | 6/1957 | Wells | 439/868 |
| 3,162,501 | 12/1964 | Wahl | 339/98 |
| 3,914,004 | 10/1975 | Bone | 339/97 |
| 3,980,379 | 9/1976 | Bone | 339/98 |
| 4,109,991 | 8/1978 | Evans | 339/99 |
| 4,160,574 | 7/1979 | DeRoss | 339/99 |
| 4,252,397 | 2/1981 | Eigenbrode et al. | 339/99 |
| 4,370,014 | 1/1983 | Bourdon | 339/97 |
| 4,842,546 | 6/1989 | Song | 439/409 |

FOREIGN PATENT DOCUMENTS

| | | |
|---|---|---|
| 2229835 | 2/1974 | Fed. Rep. of Germany . |
| 386047 | 1/1908 | France . |

*Primary Examiner*—David L. Pirlot

*Attorney, Agent, or Firm*—Thomas L. Peterson

[57] ABSTRACT

Lead terminations are provided for terminating the opposite ends of a multimeter test lead to contact devices, including a right angle banana plug contact device and an in-line test probe contact device. The test lead includes a wire having a conductor surrounded by soft easily displaced wire insulation such as silicone. Each termination includes a conductive element with a penetrating portion (such as pin portion 38 in FIG. 3, or prong 110 in FIG. 8) which is advanced into one side of the wire and which moves the wire conductor until the wire conductor moves through the opposite side of the insulation. In a right angle banana plug termination (14, FIG. 3), the contact device (20) has a pin portion (38) which penetrates through a first side of the wire insulation (32) and presses the wire conductor (30) out of an opposite second side of the insulation and against a wall of a bore in an insulative body (40). In an in-line termination (16, FIG. 8), a prong (110) formed in one side of a metal tubular portion of a contact device is advanced into one side of the wire insulation and the prong advances a location (30B) of the wire conductor through the wire insulation to press against the opposite side of the tubular portion.

14 Claims, 4 Drawing Sheets

FIG. 5
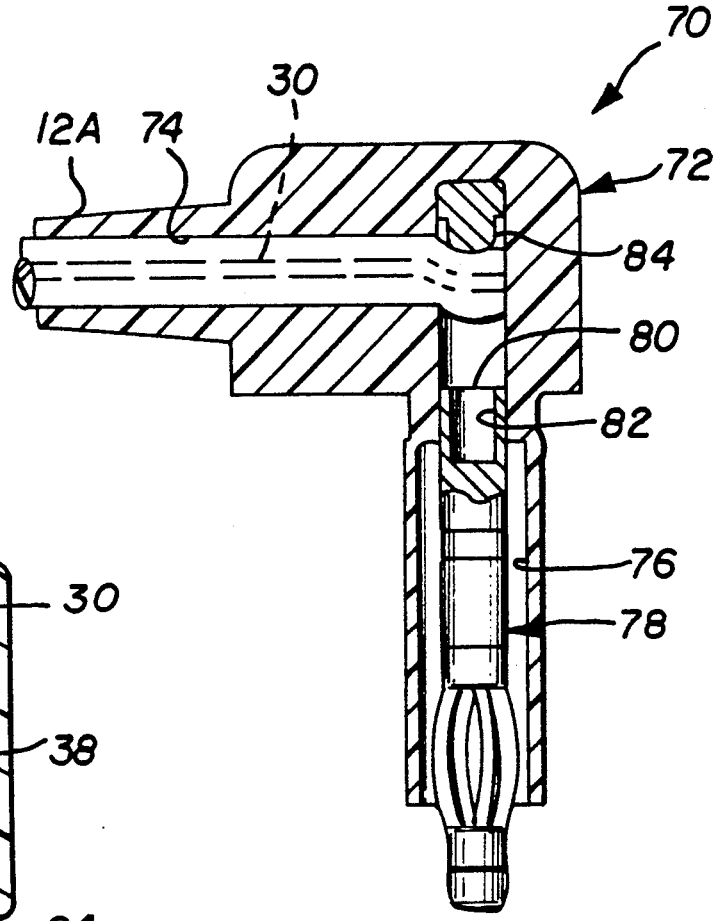
FIG. 4
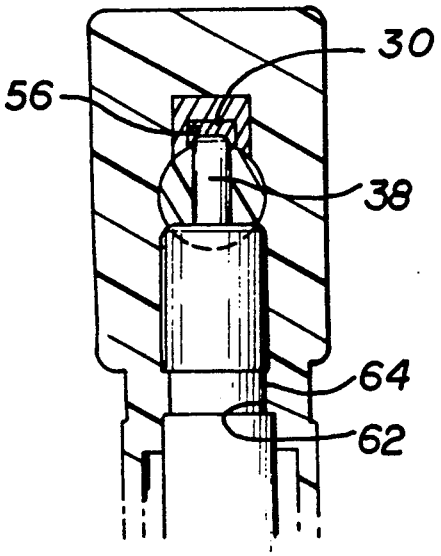
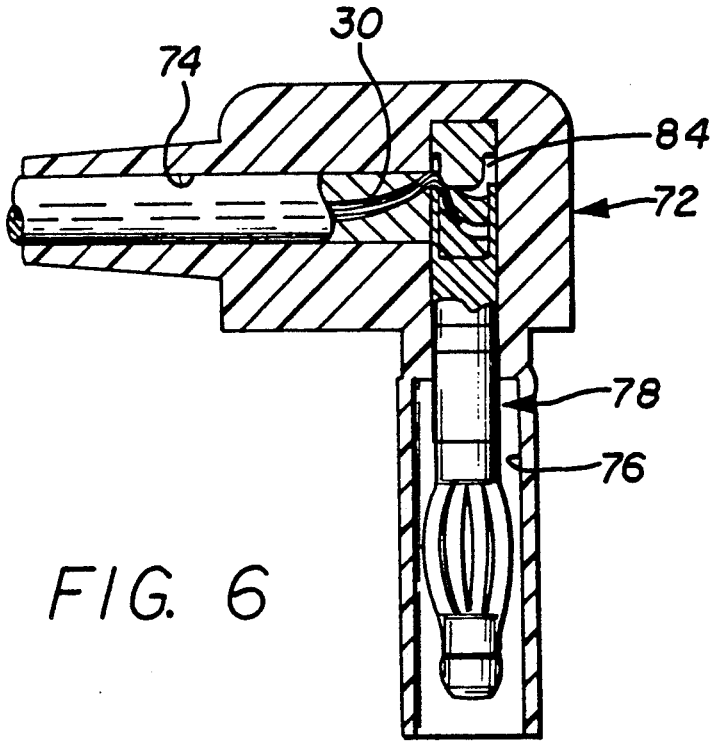
FIG. 6

LEAD TERMINATION

BACKGROUND OF THE INVENTION

Factories produce a large number of terminations where the cut end of a wire is terminated to a contact device. Techniques involving soldering and crimping have disadvantages such as requiring stripping of insulation. Insulation displacement termination techniques have many advantages, but often are not useful with wires whose conductors contain multiple strands, do not provide automatic strain relief, or allow the same termination devices and tooling to be used with wires having central conductors of different diameters. An insulation displacement wire termination apparatus and method which provided low cost and reliable terminations, would be of considerable value.

SUMMARY OF THE INVENTION

In accordance with one embodiment of the present invention, a low cost and reliable insulation displacement termination is provided for connecting the conductor of a wire to a contact device. The termination includes a contact device with a penetrating portion that penetrates into one side of the wire insulation and moves the wire conductor through the opposite side of the insulation. The penetrating portion continues to press against the now-displaced wire conductor.

In one termination, wherein the wire and an elongated contact device extend substantially perpendicular, the cut end of a wire lies in a first bore of an insulative body. A contact device lies in a second perpendicular bore of the body. The contact device has a pin-like penetrating portion which penetrates through one side of a wire insulation and presses the wire conductor through the insulation and against an opposite wall of the first bore of the body. In a second termination, wherein an elongated contact device extends largely parallel to a wire end portion, the wire end portion lies in a rear metal tubular portion of the contact device. The metal tubular portion has a slot therein which forms a metal prong. The prong, which forms a penetrating portion of the contact device, is bent to project into the wire insulation and deflect the wire conductor through the insulation and against an opposite side of the metal tubular portion.

The novel features of the invention are set forth with particularity in the appended claims. The invention will be best understood from the following description when read in conjunction with the accompanying drawings.

BRIEF DESCRIPTION OF THE DRAWINGS

FIG. 4 is a view taken on the line 4—4 of FIG. 3.

FIG. 5 is a sectional view of another embodiment of the invention somewhat similar to the first termination of FIG. 2, with the termination only partially completed.

FIG. 6 is a view similar to that of FIG. 5, but with the termination completed.

DESCRIPTION OF THE PREFERRED EMBODIMENT

Figure 1:
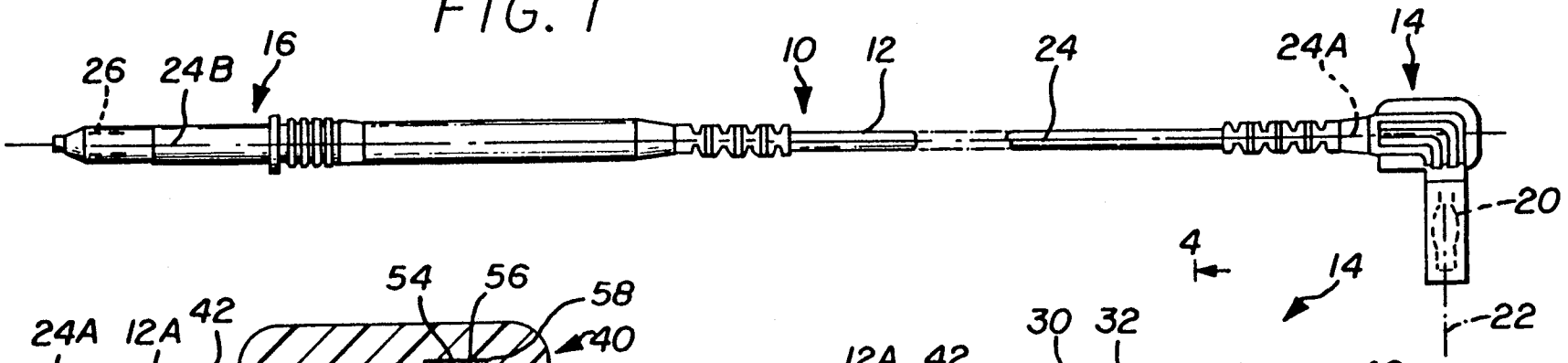
FIG. 1 is a side elevation view of a multimeter test lead which has terminations at its opposite ends constructed in accordance with the present invention.

FIG. 1 illustrates a test lead 10 which includes a wire 12 having opposite ends connected to contact assemblies at first and second terminations 14, 16. The first termination 14 includes an elongated banana plug contact device 20 which extends along an axis 22 that is perpendicular to the axis 24A of the adjacent wire portion, and is suitable for plugging into a contact hole of a multimeter. The second termination 16 includes an elongated test probe contact device which extends along an axis 24B that is in line with the axis of an adjacent portion of the wire. Factories that produce multimeter test leads require large numbers of low cost and reliable terminations that can be easily attached to opposite ends of the test lead.

Figure 3:
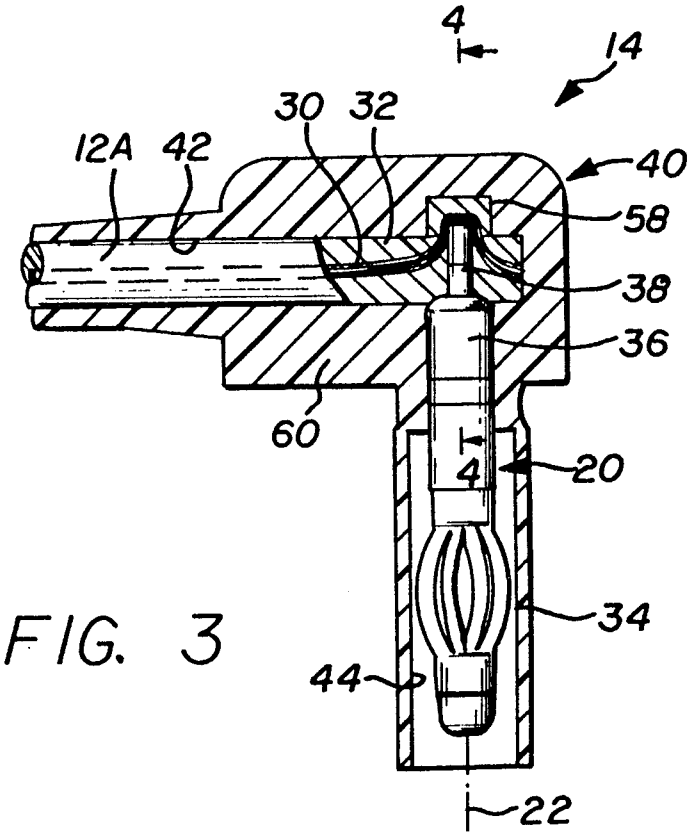
FIG. 3 is a view similar to that of FIG. 2, but with the termination completed.

FIG. 3 illustrates some details of the first termination 14 which terminates to an end portion 12A of the wire. The wire includes a metal conductor 30, which is usually formed of numerous thin wire strands for flexibility of the lead, and a wire insulation 32 that surrounds the conductor. The contact device 20 includes a banana plug 34 and a rod 36 with an insulation penetrating pin portion 38 at its upper end. The wire and contact device lie in an insulative body 40 having a pair of bores 42, 44 that extend perpendicular to one another and which intersect.

Figure 2:
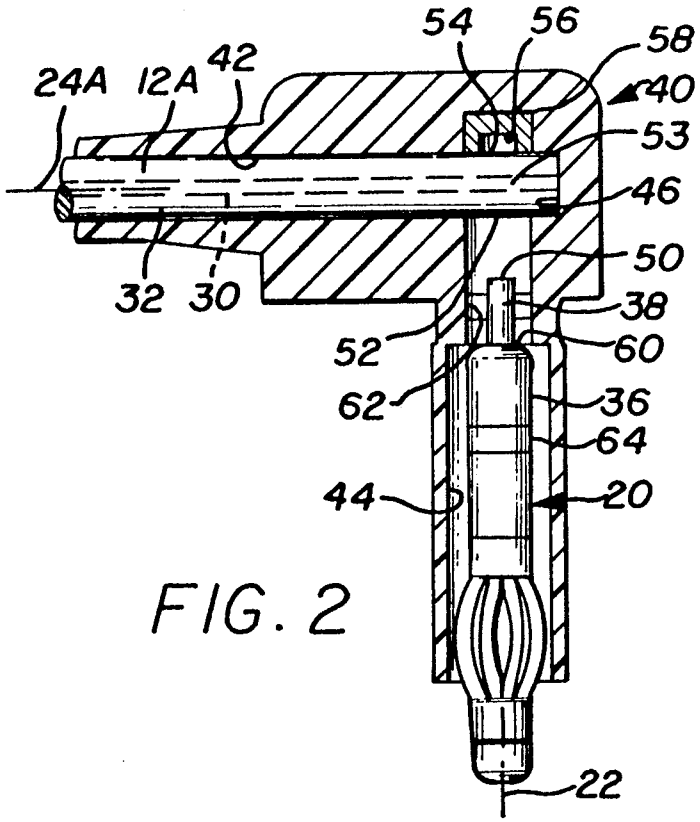
FIG. 2 is a sectional side view of a first termination of the test lead of FIG. 1, with the termination only partially completed.
Figure 7:
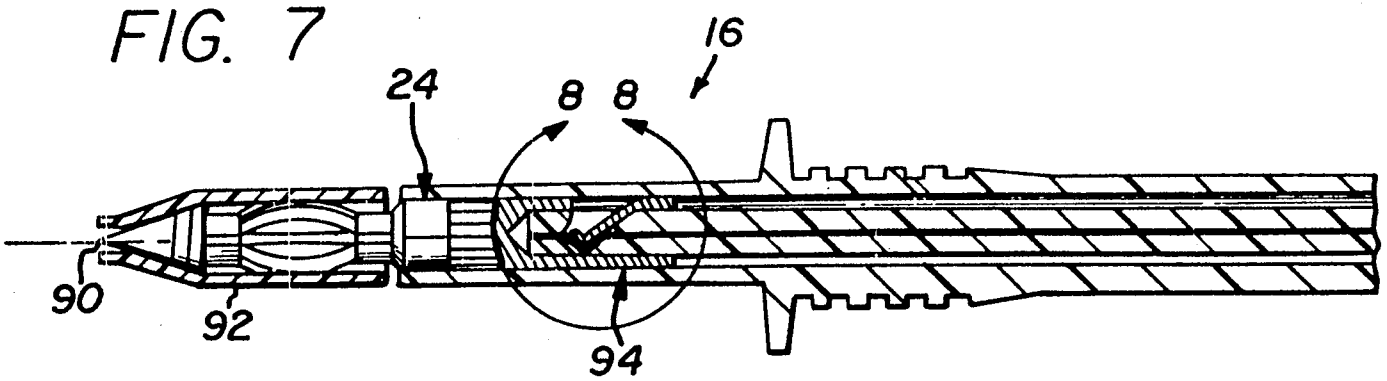
FIG. 7 is a sectional view of the second termination of the test lead of FIG. 1.

As shown in FIG. 2, the termination is made by first projecting a cut end 12A of the wire through the first bore 42. The first bore is a blind bore with an end at 46 that extends beyond the intersection with the second bore 44. The first bore closely receives the wire. After the wire is installed, the contact device 20 is projected upwardly, or forwardly, along the axis 22 until the front end or tip 50 of the insulation penetrating contact pin portion 38 bears against the lower side 52 of the wire, at a wire displacement location 53 along the first bore. The contact device is advanced upwardly with sufficient force to penetrate into the lower side of the wire insulation, displacing the insulation in the process, until the tip 50 of the pin portion engages the wire conductor 30. The contact device continues to be advanced upwardly to force the wire conductor 30 to press through the insulation until it emerges from an upper side 54 of the insulation, into a recess 56 in the first bore that lies in line with the second bore 44. The pin portion deflects the wire conductor into this recess, providing a press interference fit between pin portion 38 and the walls of hole 56, with the wire caught between them.

Although it is possible to form the recess 56 directly in the insulative material of most of the body 40, applicant prefers to use a metal insert or bushing 58 that is installed before the wire is installed. The metal insert avoids a "creep effect" wherein the wire conductor could creep out of the first bore 42. No sharp edges are allowed on the walls of hole 56 or at the tip so to avoid severing the wire conductor.

As the contact device is pushed upwardly, its shoulder 60 which lies around the rear end of the pin portion 38, presses against the lower side 52 of the wire insulation. The pressing of the shoulder 60 causes it to grip the wire insulation to help resist pullout of the wire from the insulative body 40. At full installation of the contact device, a ring-shaped projection 62 of the body insulation snaps into a groove 64 of the rod 36 of the contact device rod, to lock the contact device in place.

The wire insulation 32 is preferably of soft and easily displaced material such as silicone. This facilitates penetration by the pin portion of the contact device, and subsequent penetration by the wire conductor. The insulative body 40 of the termination is preferably of a harder insulative material such as Nylon. The termination can be constructed for low cost, high volume production. The contact device 20 is similar to prior art contact devices, except that it includes the narrower pin portion and the snap-in groove, which do not substantially increase its cost. The insulative body 40 is an easily molded part, especially because the contact device is not a molded-in insert. Mass production assembly is easily accomplished, because it is only necessary to insert the wire in the first bore, and then the contact device in the other bore until it snaps into place, all of which is easily accomplished.

The termination 14 provides a reliable termination. With the pin portion 38 pressing the wire conductor against the relatively hard insulative body 40, and with the wire conductor bent and pressed around the tip 50 of the pin portion, good contact is made. The fact that the wire conductor is bent near its location of contact with the pin portion, results in reduced possibility that the wire conductor will pull out of the body. With the shoulder 60 of the contact device pressing against the wire insulation, the wire insulation is also trapped in place. With a wire of a diameter of about 3.6 mm (0.140 inch), the shoulder 60 preferably penetrates into the insulation by at least about 8% of the diameter or about 0.3 millimeter (0.012 inch), but less than the radius of the wire.

FIGS. 5 and 6 illustrate another insulation displacement terminal 70 somewhat similar to that of FIGS. 2–4, in that it includes an insulative body 72 with perpendicular bores 74, 76 for respectively receiving a wire end portion 12A and a contact device 78. However, the contact device has a forward end 80 with a central hole 82 to leave a ring-shaped forward end. In addition, the body forms a protuberance 84 along the first bore 74 where it lies in line with the second bore 76. When the wire 12A is inserted, its end is deflected downwardly about the protuberance 84. When the contact device 78 is pushed upwardly, or forwardly, it bends the wire conductor 30 upwardly. It is noted that applicant originally constructed the termination as shown in FIGS. 5 and 6, and later developed the design shown in FIGS. 2–4. The design shown in FIGS. 2–4 was found to be superior in the tests that applicant performed, because it has a greater contact area, has better cable retention, is less affected by creep, and easily provides a press fit when engaged with a wire.

FIGS. 7–11 illustrate details of the second in-line termination 16. The second termination includes a metal contact device 24 which, in this case, is a test probe with a tip 90 that can contact one of many closely-spaced traces on a circuit board, and with the tip portion covered by an insulative cap 92. The probe has a tubular rear portion 94, shown in greater detail in FIG. 8. The tubular rear portion has an open rear end 96 for receiving a wire end portion 12B. The wire end has been cut, and is pressed into a blind hole 98 formed by the tubular portion, and extends rearwardly out from the tubular portion. The termination also includes an insulative body 100 surrounding at least the tubular rear portion of the contact device.

Figure 9:
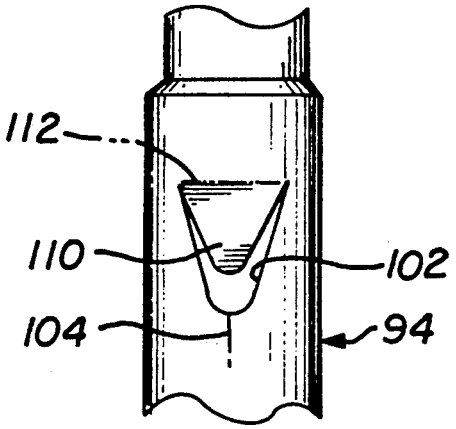
FIG. 9 is a partial top view of the rear tubular portion of the contact device of FIG. 8.
Figure 10:
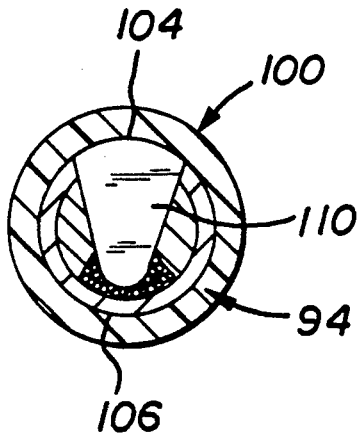
FIG. 10 is a view taken on the line 10—10 of FIG. 8.

As shown in FIG. 9, the tubular rear portion 94 of the contact device has a slot 102 in a first side 104 of the tubular portion which lies opposite side 106. The slot forms a prong 110 which can be bent, as along a bend line 112 at the rear ends of the curved slot. The prong, which forms a penetrating portion of the contact device, is bent to displace a region of the wire insulation 32 and to displace a location 30B of the wire conductor so it presses against the second side 106 of the contact device rear tubular portion at the inside of the tubular portion.

Figure 11:
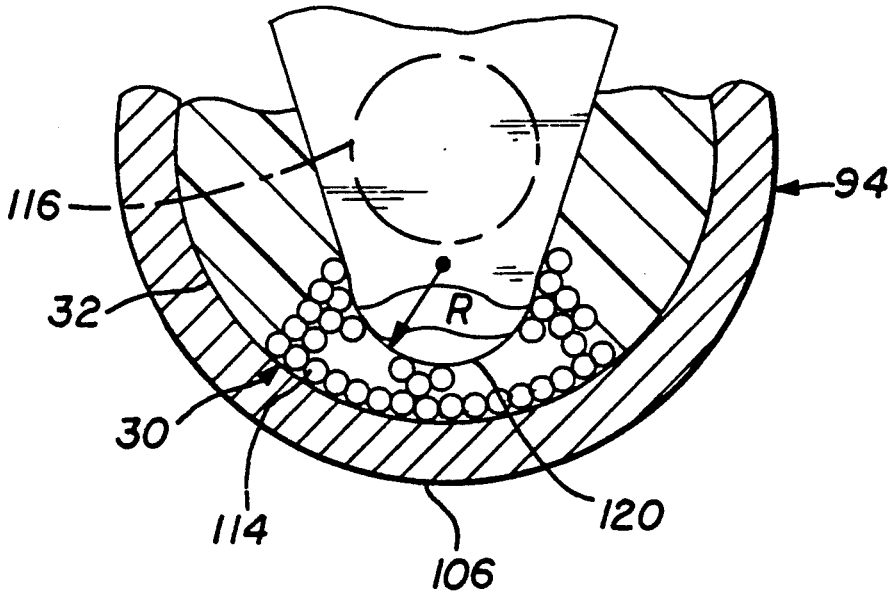
FIG. 11 is an enlarged view of part of the termination of FIG. 10.

As shown in FIG. 11, the wire conductor 30 includes multiple conductive strands 114 that initially lie within an imaginary circle 116 centered on the outside of the wire insulation 32. The tip 120 of the prong presses against the wire strands and deforms them from their original circular shape, but still presses many of them securely against the second side 106 of the tubular rear portion. In order to assure that the prong will press a large portion of the wire conductor through the wire insulation, instead of merely separating the strands, the probe tip is rounded, with a large radius of curvature R, which is more than one half the radius of the circle 116 which define the edge of the original wire conductor, with the radius of the prong tip preferably being at least about as great as the radius of the circle 116.

Figure 8B:
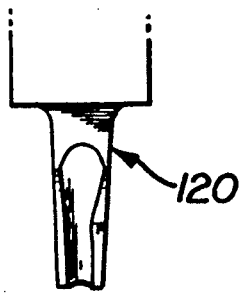
FIGS. 8A and 8B are respectively side elevation and front elevation views of a piercing and displacing tool useful to construct the apparatus of FIG. 8.
Figure 8A:
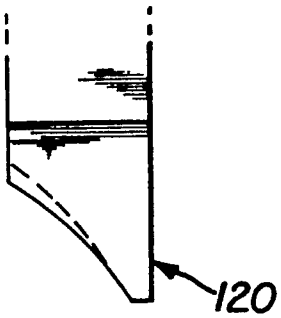
Figure 8:
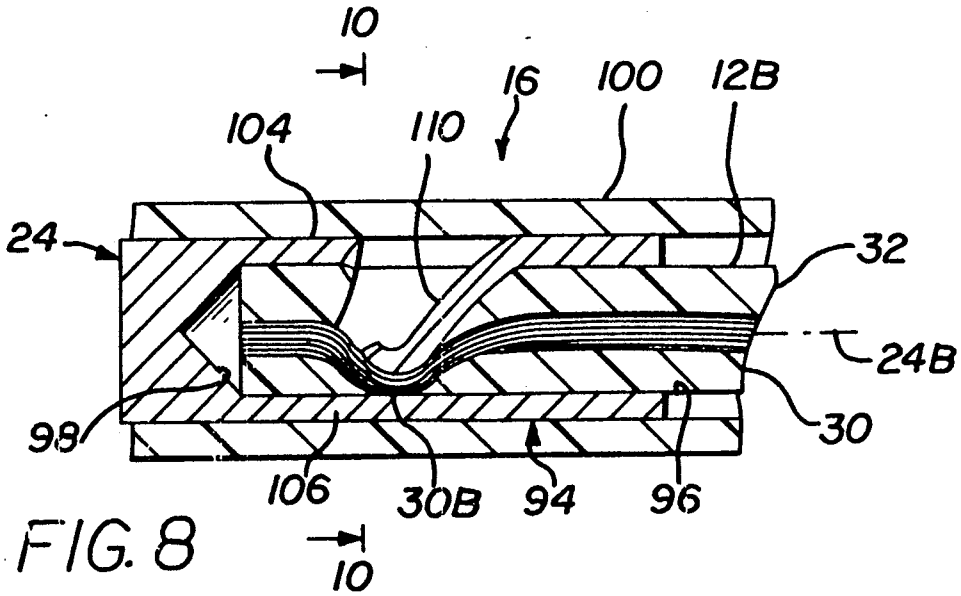
FIG. 8 is an enlarged view of the region 8—8 of FIG. 7.

The termination is made by forming the slot 102 in the rear tubular portion of the contact device, but without bending the resulting prong 110. The wire end portion 12B is inserted into the tubular rear portion 94 at a time when the tubular rear portion is not surrounded by the insulative body 100. Then a piercing and displacing tool shown at 120 in FIGS. 8A and 8B, is pressed against one side 104 of the tubular member to pierce it and punch out the prong 110 from the rest of the tubular member and to bend the prong. As the prong is forced to bend, its tip displaces the wire insulation until the prong tip presses against the wire conductor, and then moves the wire conductor so it displaces insulation until the wire conductor presses against the second side 106 of the tubular rear portion. Then, the insulative body is slid to lie around the tubular rear portion and around the wire region projecting rearwardly from the contact device.

The contact device, including the tubular rear portion 94, is formed of a ductile material such as free machining brass. As a result, there is substantially no springiness which would urge the deformed prong to spring back after it has deformed the wire. Applicant prefers to have the prong or probe 110 extend at an angle A of between about 30° and 45° to the axis 24B of the wire. The probe then securely resists pull out of the conductor. As discussed above, the wire insulation is preferably of soft material such as silicone, to facilitate its displacement. The probe provides strain relief for the wire, because the probe tip resists rearward movement of the wire conductor and the probe sides resist rearward movement of the wire insulation.

The contact device 24 and the tool for depressing the prong, can be used with wires having conductors of different diameters. The only change that is required is the depth of depression of the probe of the tubular rear portion of the contact device.

Thus, the invention provides a wire or lead termination which can be made at low cost, especially in mass production, and which provides reliable connection of a contact device to a wire. The termination includes a contact device with a wire insulation penetrating portion such as a pin portion or prong, which is pressed against a side of a wire to displace the wire insulation until the displacing element engages the wire conductor, and which then moves the wire conductor to cause it to displace an additional portion of the wire insulation, preferably until the wire conductor has passed through the insulation. In one termination, a pin portion of a contact device presses the wire conductor against an inside wall of a body of material harder than that of the wire insulation. In another termination, a prong formed in a tubular rear portion of a contact device, presses the wire conductor against one side of the tubular contact portion which lies opposite the prong.

Although particular embodiments of the invention have been described and illustrated herein, it is recognized that modifications and variations may readily occur to those skilled in the art, and consequently, it is intended that the claims be interpreted to cover such modifications and equivalents.

We claim:

1. A substantially perpendicular lead termination comprising:

a substantially insulative body having first and second perpendicular arms and having walls forming first and second intersecting perpendicular bores lying respectively in said first and second arms;

a wire having a wire conductor and a wire insulator surrounding said conductor, said wire having an end portion lying in said first bore;

a contact device which lies in said second bore, said device having a pin portion which penetrates said wire insulation and presses said wire conductor through said wire insulation and against the walls of said first bore.

2. The termination described in claim 1 wherein:

said wire insulation is of soft easily-penetrated material while said body is formed of a harder and more penetration-resistant material.

3. The termination described in claim 1 wherein:

said pin portion lies at the front of said contact device, and said contact device includes a shoulder at the rear of said pin portion, said shoulder pressing into said insulation to hold said insulation from movement out of said first bore.

4. The termination described in claim 1 wherein:

said first bore extends beyond its intersection with said second bore and has a recess in line with said second bore, and said pin portion has a front end that bears against said wire conductor and presses it into said recess, with said wire conductor sharply bent at either side of said front end of said pin portion.

5. The termination described in claim 4 wherein:

said body is formed primarily of insulative material with a hole around said recess, and said body includes a metal insert that lies in said hole and that forms said recess.

6. The termination described in claim 1 wherein:

said pin portion has a forward end which bears against said wire conductor, said forward end having a central hole to leave a ring shaped end.

7. The termination described in claim 6 wherein:

the walls of said first bore have a protrusion in line with at least one side of said ring shaped end.

8. A substantially in-line lead termination comprising:

a contact device which has a tubular rear portion with an open rear end;

a wire having a wire conductor and a wire insulation surrounding said conductor, said wire having a wire end portion lying in said tubular portion of said contact device, said wire extending rearwardly out of said open rear end of said tubular portion;

an insulative body surrounding at least said tubular rear portion of said contact device;

said tubular rear portion of said contact device having a slot at one side of said tubular portion which forms a bendable prong, said prong being bent so it extends into said wire insulation and presses said wire conductor and displaces it through said insulation and against a side of said tubular portion that lies opposite said slot.

9. The termination described in claim 8 wherein:

said wire conductor includes a plurality of conductive strands lying within an imaginary circle as seen in a sectional view of said wire;

said prong has a convexly rounded end which presses against said conductor, said prong end having a radius of curvature which is more than one-half the radius of said imaginary circle, whereby to enable penetration of the insulation and firm pressing against the strands of said conductor without completely splitting them apart.

10. The termination described in claim 8 wherein:

said prong has an end lying furthest from said slot, and said prong is tapered along most of its length to converge towards said prong end, whereby to enable the prong to resist pullout of the insulation.

11. A method for terminating a wire having a central conductor and having insulation surrounding the conductor, to an elongated contact device which is to extend substantially perpendicular to the wire, comprising:

inserting a cut end of said wire through a first bore in an insulative body;

inserting said contact device in a predetermined forward direction through a second bore in said body which extends perpendicular to said first bore and intersects said first bore, until a forward end of said device lies against a side of said insulation, and continuing to move said contact device forwardly to cause said device end to penetrate said insulation until said device end engages and presses against said conductor and then presses said conductor completely through said insulation and against the walls of said first bore.

12. A method for terminating a wire having a central conductor and insulation surrounding the conductor, to an elongated contact device which is to extend largely in-line to the wire, comprising:

forming a contact device with a rear tubular portion that can closely receive said wire and that has an open rear end, and with a cut in a first side of the walls of the tubular portion to form a prong having a free forward portion with a rounded forward tip and having a rear end attached to the rest of the tubular portion;

inserting a cut end of the wire into said tubular portion through the open rear end thereof;

deforming said prong to move its forward portion towards a second side of said tubular portion which lies opposite said first side, including moving said prong to displace said insulation until said prong contacts said wire conductor, and continuing to move said prong and to move the wire conductor until the conductor contacts said second side of said tubular portion;

inserting said contact device into an insulative body until at least said prong is surrounded by said body.

13. The method described in claim 10 wherein:

said step of forming a cut to form a prong, is accomplished after said wire end is inserted, and at the same time as said prong is deformed towards said second side.

14. A method for terminating a wire having a wire conductor and a wire insulation surrounding the conductor, to a contact device having an insulation displacing contact portion, comprising:

inserting said wire into a first bore of a body of material that is harder than said wire insulation;

pressing said contact portion of said contact device into a first side of said wire to displace said insulation until said contact portion contacts a location along said conductor, and pressing said contact portion further into said wire to move said conductor location so it displaces said insulation and emerges from a second side of said wire that lies opposite said first side, and supporting said conductor where it has emerged from said second side of said wire while continuing to keep said contact portion pressing against said conductor;

said step of pressing includes inserting said contact device into a second bore of said body which intersects said first bore so said contact portion can penetrate into the portion of said wire that lies in line with said second bore, said step of supporting including pressing said wire conductor against walls of said body which forms said first bore.

* * * * *